US008047141B2

(12) United States Patent
Bramauer

(10) Patent No.: US 8,047,141 B2
(45) Date of Patent: Nov. 1, 2011

(54) STEP ACTUATOR

(75) Inventor: Johann Bramauer, Ybbsitz (AT)

(73) Assignee: Knorr-Bremse Gesellschaft mit beschrankter Haftung, Modling (AT)

( * ) Notice: Subject to any disclaimer, the term of this patent is extended or adjusted under 35 U.S.C. 154(b) by 322 days.

(21) Appl. No.: 11/884,803

(22) PCT Filed: Feb. 9, 2006

(86) PCT No.: PCT/EP2006/001132

§ 371 (c)(1),
(2), (4) Date: Apr. 24, 2008

(87) PCT Pub. No.: WO2006/087130

PCT Pub. Date: Aug. 24, 2006

(65) Prior Publication Data

US 2008/0256871 A1 Oct. 23, 2008

(30) Foreign Application Priority Data

Feb. 21, 2005 (AT) ..... A 280/2005

(51) Int. Cl.
*B61D 23/02* (2006.01)

(52) U.S. Cl. ..... 105/437; 280/166; 296/155

(58) Field of Classification Search ..... 296/62, 296/162; 280/163, 166; 105/437, 438, 447
See application file for complete search history.

(56) References Cited

U.S. PATENT DOCUMENTS

| | | | | |
|---|---|---|---|---|
| 987,329 | A * | 3/1911 | Scullin et al. | 105/341 |
| 988,363 | A * | 4/1911 | Malocsay | 105/437 |
| 1,359,396 | A * | 11/1920 | Lerner et al. | 105/436 |
| 2,056,226 | A | 10/1936 | Mussey et al. | |
| 4,570,962 | A * | 2/1986 | Chavira | 280/166 |
| 4,879,845 | A | 11/1989 | Nunes | |
| 5,498,012 | A * | 3/1996 | McDaniel et al. | 280/166 |

FOREIGN PATENT DOCUMENTS

| | | | |
|---|---|---|---|
| DE | 845 522 | | 8/1952 |
| DE | 2 057 365 | | 3/1972 |
| DE | 23 38 378 | | 2/1975 |
| DE | 27 23 995 | A1 | 12/1978 |
| DE | 42 18 006 | A1 | 12/1993 |
| DE | 94 03 980.1 | U1 | 5/1994 |
| DE | 94 03 982.8 | U1 | 5/1994 |
| DE | 195 31 284 | A1 | 2/1997 |
| EP | 0 936 120 | A1 | 8/1999 |
| FR | 2 297 758 | | 9/1976 |
| SU | 977234 | | 11/1982 |
| SU | 1318455 | | 6/1987 |

OTHER PUBLICATIONS

Communication from POCHATEHT "Russian Examination Report" dated Oct. 12, 2009.

* cited by examiner

*Primary Examiner* — Glenn Dayoan
*Assistant Examiner* — Melissa A Black
(74) *Attorney, Agent, or Firm* — Barnes & Thornburg LLP

(57) ABSTRACT

A step drive for a movable step, the step drive being arranged below a swinging-sliding door. The step drive includes an opening-out mechanism located in a lower region of a secondary closing edge of the swinging-sliding door. The opening-out mechanism is connected to and actuated by a door drive and the opening-out mechanism interacts with the movable step.

9 Claims, 6 Drawing Sheets

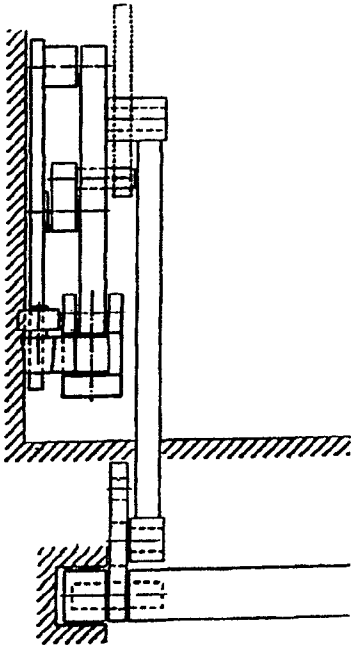
Fig. 8
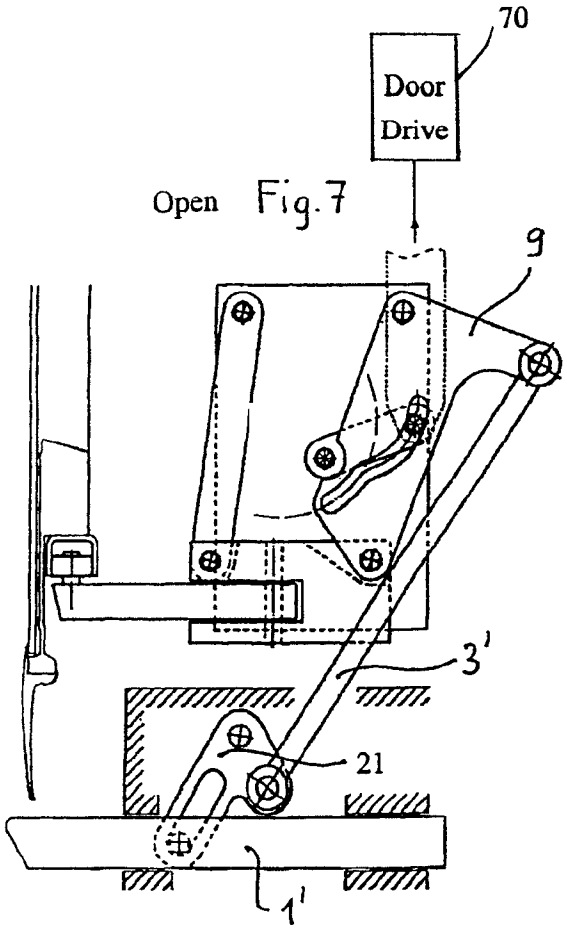
Open Fig. 7

9'
19
1'

70
Door Drive
Closed and locked 9
17
9'
21
19
1'

STEP ACTUATOR

BACKGROUND AND SUMMARY

The present disclosure relates to a step drive for a movable step, such as a folding step or sliding step. The step drive is arranged below a swinging-sliding door. In a lower region of a secondary closing edge, the swinging-sliding door has an opening-out mechanism which is connected to and can be actuated by the door drive.

Steps in rail vehicles are nowadays customarily driven by a dedicated motor or a pneumatic cylinder or rotary cylinder.

DE 42 18 006 discloses a drive device for foldable steps below a swinging-sliding door. The pivoting action of a pivoting roller lever comprising a journal engaging in a guide of the door leaf produces the swinging movement of the door leaf. The pivoting roller lever is coupled to the horizontal drive shaft of the step via a transmission shaft and a bevel gear mechanism. The pivoting roller lever is actuated via a dedicated drive element, for example, in the form of a pneumatic cylinder. The pivoting roller lever is not connected to the door drive arranged in the upper region of the door. The use of two independent drives requires not only an elaborate synchronization of the two drive elements but also incurs considerable costs owing to the respective double design of the drive, levers, cylinders, etc.

DE 20 57365 discloses a folding drive whose horizontal pivot shaft is connected to and controlled by the vertical rotary shaft of a pivoting door, swinging door or pivoting-folding door. An opening-out mechanism for the door in the lower region is not provided.

In a few isolated instances, solutions are also known in which the step is driven via a linkage which operates with a door drive arranged in the roof region of the vehicle.

DE 27 23 995 discloses a folding step for a swinging-sliding door which is connected to and can be pivoted by the door drive via a complicated lever mechanism in the region above the door leaf. A floor-side locking mechanism or opening-out mechanism for the door leaf is not provided. Such a complex lever mechanism connected to the folding step via a rod and a further lever is prone to failure and consequently requires frequent maintenance.

The prior art door drives are thus either directly connected to the door drive arranged in the upper region of the coach body via complicated, failure-prone and cost-incurring mechanisms, or require a dedicated drive synchronized with the door drive. The present disclosure relates to overcoming these disadvantages and providing a step drive which folds down and in, or extends and retracts, reliably with the opening and closing of the door.

According to the present disclosure, a step drive includes an opening-out mechanism that interacts with the step.

The step drive according to the present disclosure makes it possible for the opening-out or locking mechanism in the lower region of the door leaf to be used to drive the step. No additional drives, transmission mechanisms or the like are required. The step is thus brought into the folded-out state, or extended state in the case of sliding steps, at the same time as the door opens, and folds up, or retracts, as the door closes.

A folding step is actuated by a rod which is pivotally mounted on a lever of the opening-out mechanism and on the step.

In the case of sliding steps, the movement is transmitted either directly, for example, via an extension of a lever of the opening-out mechanism, or via connecting elements such as, for example, a lever system.

Other aspects of the present disclosure will become apparent from the following descriptions when considered in conjunction with the accompanying drawings.

BRIEF DESCRIPTION OF THE DRAWINGS

FIG. 7 shows a step drive, according to the present disclosure, with the door open and the sliding step extended.

FIG. 8 shows a side view of the step drive shown in FIG. 7.

DETAILED DESCRIPTION

Figures 1, 2:
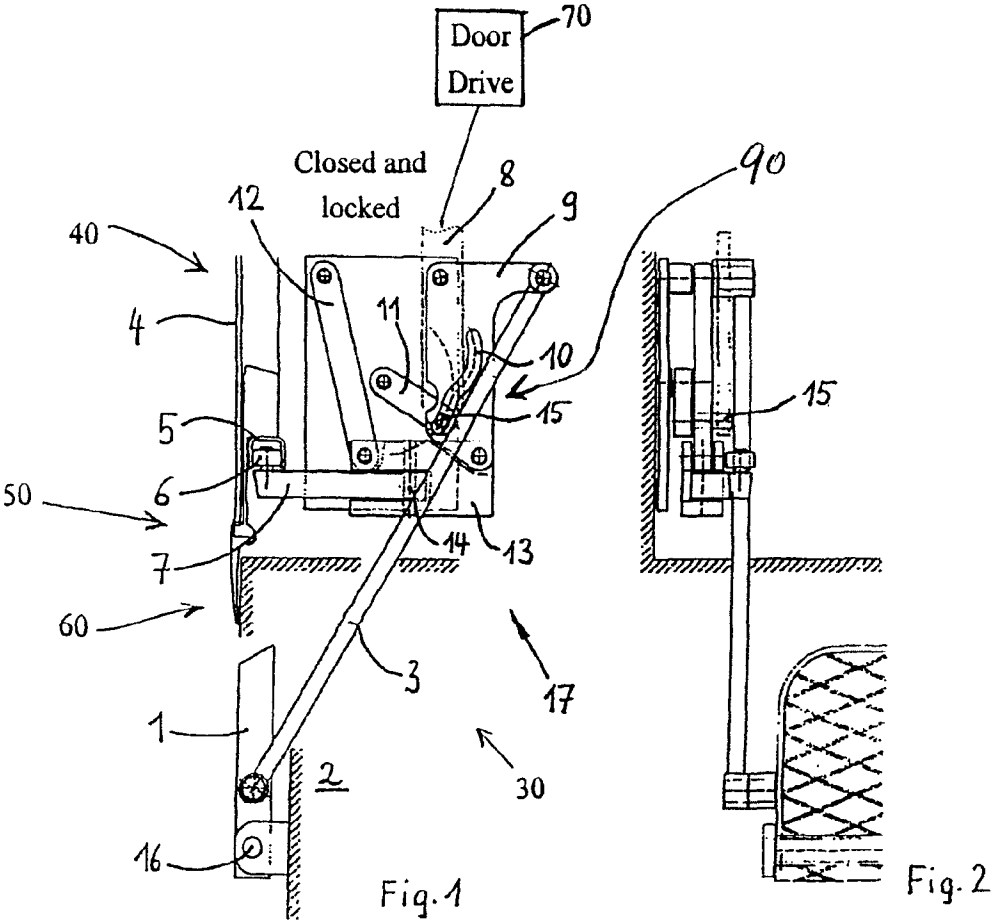
FIG. 1 shows a step drive, according to the present disclosure, with the door closed and the folding step locked.
FIG. 2 shows a side view of the step drive shown in FIG. 1.

FIG. 1 shows a step actuator or step drive 30, according to the present disclosure, in which a movable or foldable step 1 is arranged on a coach body 2 below an entrance, such that the foldable step 1 can pivot about a horizontal axis 16 which is substantially parallel to a door 40 center plane (not shown). A locking or opening-out mechanism 17 for a door leaf 4 in a lower region 50 of a secondary closing edge 60 ensures that the door leaf 4 is swung away from the coach body 2. The opening-out mechanism 17 is actuated via a drive rod 8 which is connected to a door drive 70, which is situated in an upper region or above the door in the coach body 2. When the door 40 opens, the rod 8 is pulled upward by the door drive 70, thus causing the pivoting roller lever 7 and the door leaf 4 to be moved away from the coach body 2 via a lever mechanism. The engagement of a guide roller 6, which is rotatably mounted on the pivoting roller lever 7, in a guide rail 5 arranged at the lower end of the door leaf 4 allows the door leaf 4 to slide in an opening or closing direction.

Figure 4:
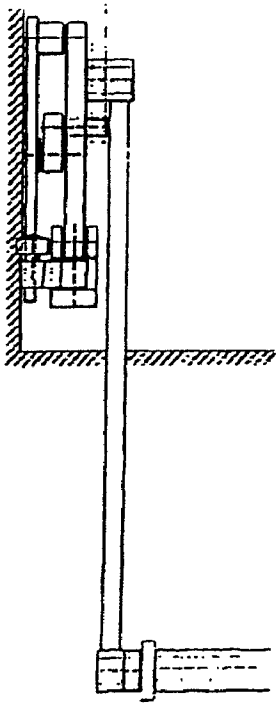
FIG. 4 shows a side view of the step drive shown in FIG. 3.
Figure 6:
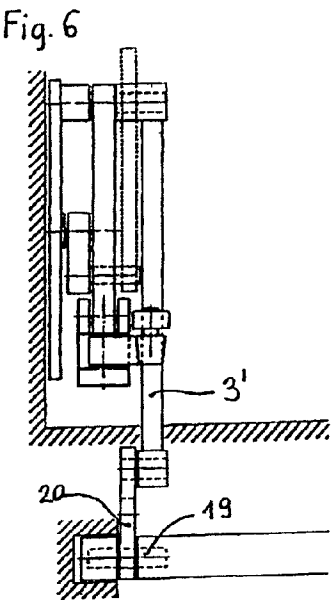
FIG. 6 shows a side view of the step drive shown in FIG. 5.
Figure 5:
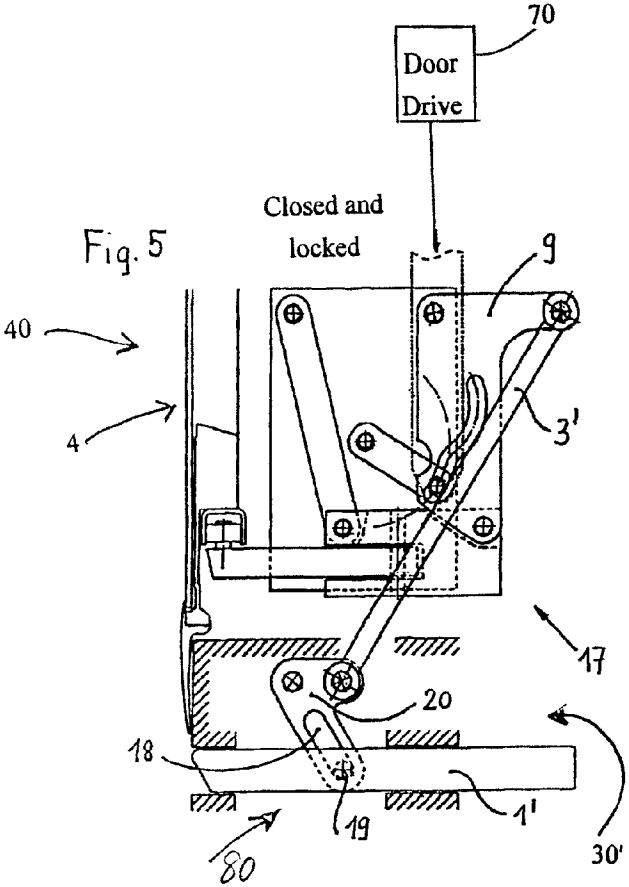
FIG. 5 shows a step drive, according to the present disclosure, with the door closed and the sliding step retracted.
Figure 10:
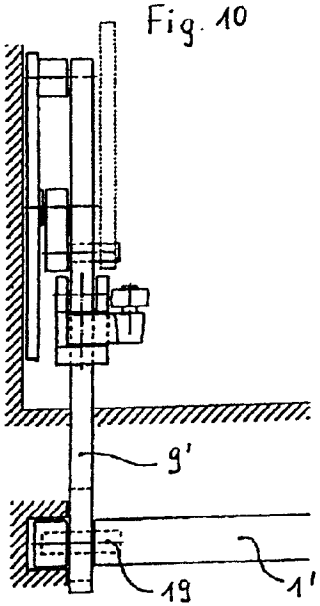
FIG. 10 shows a side view of the step drive shown in FIG. 9.
Figure 9:
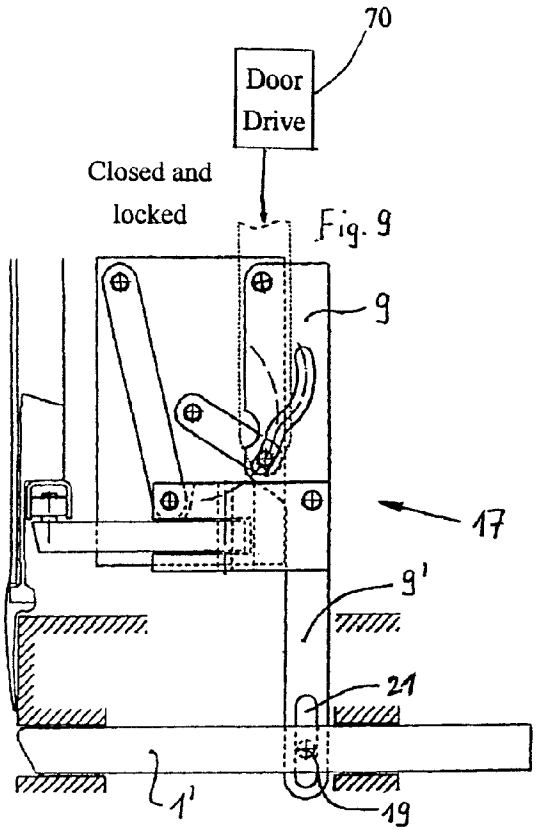
FIG. 9 shows a step drive, according to the present disclosure, with the door closed and the sliding step retracted.
Figure 12:
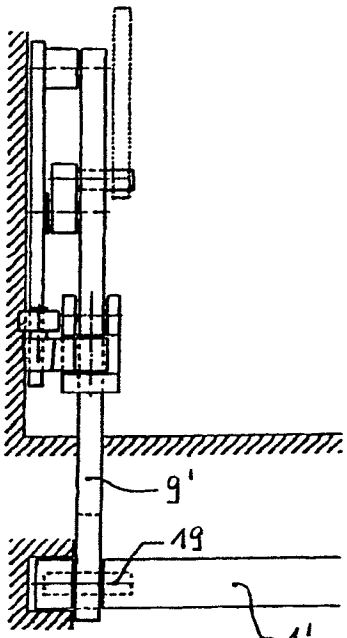
FIG. 12 shows a side view of the step drive shown in FIG. 11.
Figure 11:
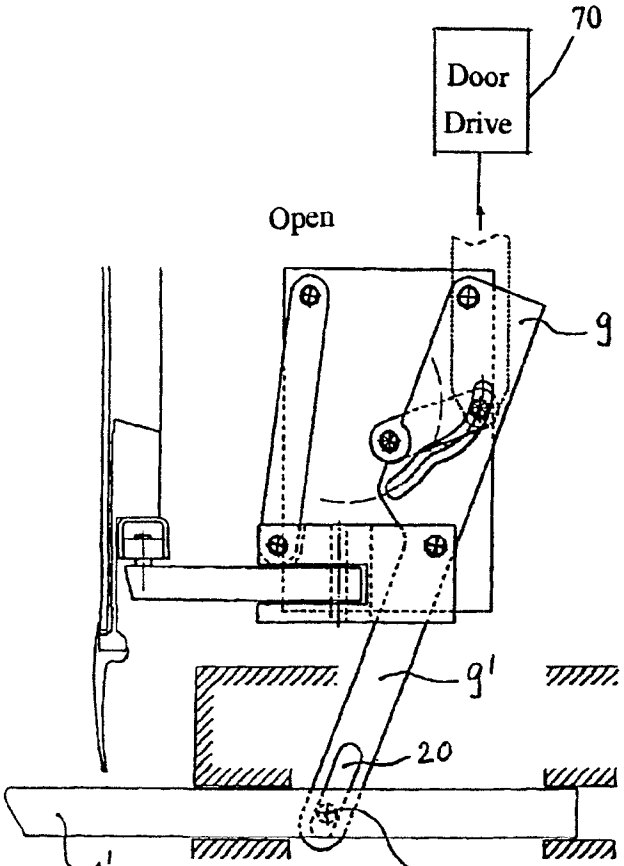
FIG. 11 shows a step drive, according to the present disclosure, with the door open and the sliding step extended.

The pivoting roller lever 7 is mounted in a mount 13 such that roller lever 7 can rotate about a vertical axis 14. The mount 13 is suspended from the coach body 2 on a rod 12 and a lever 9. The rod 12 and the lever 9 are each pivotally connected to the coach body 2, either to a platform mounted on the coach body 2, on the one hand, or to the mount 13, on the other hand. Four hinge points form the corners of a parallelogram, as seen in FIG. 1. A pin 15, which is situated at an end of the drive rod 8 and which is rotatably mounted, engages in a guide 10 of the lever 9. At the same time, the drive rod 8 is connected to a rod 11, which is rotatably mounted on the coach body 2 or on the platform, so as to define a circular path for the pin 15 when the drive rod 8 is pulled upwardly. FIGS. 2 and 4 make it clear that, in an embodiment of the present disclosure, the pin 15 passing through the guide 10 of the lever 9 connects the drive rod 8 and the rod 11 to one another.

Figure 3:
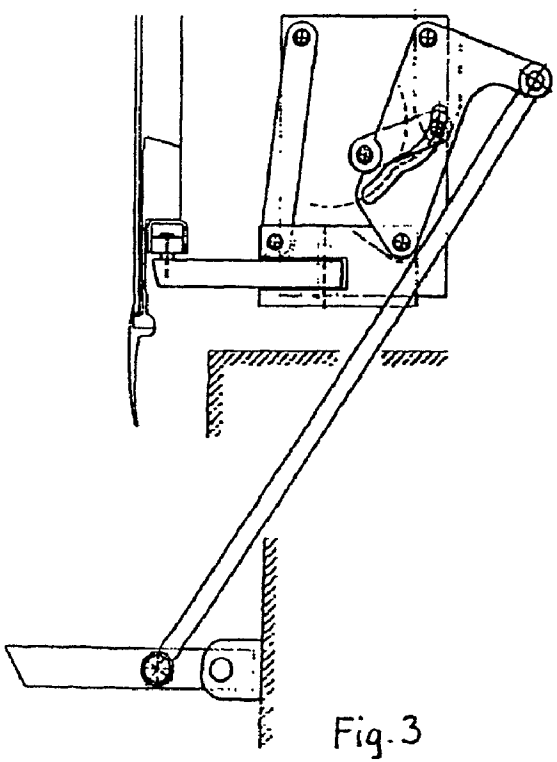
FIG. 3 shows a step drive, according to the present disclosure, with the door open and the folding step folded out.

According to the present disclosure, the step 1 and the lever 9 are thus connected to one another by a connecting element 3. This element 3 is pivotally connected both to the lever 9 and to the step 1. When the swinging-sliding door 40 opens, the drive rod 8 moves upwardly and with pin 15 forces the lever 9 to pivot toward the right, as shown in FIG. 3. This movement presses the connecting element 3 in a direction toward step 1 and thereby causes the step 1 to fold down.

In an embodiment of the present disclosure, the guide 10 in the lever 9 is bounded by stops, and thus ensures not only that the folding step 1 is securely held and locked while the vehicle is traveling but also that the step 1 is securely held in the open position. In order to relieve a load on the step drive 30 when the step 1 is folded down, it is of course possible for additional stops (not shown) to be provided on the coach body 2 itself. The two-part form of the guide 10, in combination with the rod 11, wherein the lower part of the guide 10 extends along a circle at whose center point the rod 11 with the pin 15 is rotatably mounted, results in a dead-center line or a dead-center region which reliably prevents the possibility of the step 1 being brought into a stepping position by an action of external forces when the door is closed.

The connecting element 3, which may by a rod, is pivotally connected both to the lever 9 and to a lateral edge of the step 1. In an embodiment of the present disclosure, the connecting element 3 additionally comprises spring means which damp loads and vibrations and thus protect the opening-out mechanism 17 from damage. For example, two tubes capable of telescoping one inside the other can be connected to one another via a spring. However, it is also possible for the lever 9 and the step 1 to be connected via respective springs to the connection rod 3. In an embodiment of the present disclosure, the length of the connecting element 3 is adjustable, for example, via screws which allow two parts of the connecting element 3 to be displaced relative to one another. This can be achieved, for example, via left-hand threads, right-hand threads or differential threads. It would also be conceivable for the connecting element 3 to include a plurality of interacting levers.

A torsion spring (not shown) may be mounted in the axis of rotation 16 of the step 1. The torsion spring would serve to secure the position of the folded-in step while the vehicle is traveling.

An advantage of an embodiment of the present disclosure (see FIGS. 2 and 4) lies in the flat design of the step drive 30 together with the opening-out mechanism 17 for the door leaf 4. The whole assembly of the step drive 30 and opening-out mechanism 17 can thus be mounted compactly on a vertical wall of a doorway and be provided with a covering without taking up much space as a result. To make access impossible for unauthorized persons, the assembly, including the opening-out mechanism 17 and step drive 30 can, of course, also be arranged behind the vertical wall of the doorway.

The compact, flat design noted above and the fact that all the axes of rotation extend horizontally mean that ground clearance is also ensured. Since only drilled holes are required in one direction, it is also possible for the production outlay on a step drive 1, according to the present disclosure, to be kept extremely low.

The present disclosure is not restricted to the disclosed embodiments. A step which can be folded upward is also conceivable. In such a case, the connecting element 3 could act at a point beyond the hinge 16 on an extension of the step 1, such that a downward pressing movement of the connecting element 3 causes an upward folding of the step 1.

According to the present disclosure, the embodiments of FIGS. 5 to 8 show sliding steps 1' instead of folding steps 1. The sliding step 1' is arranged below the entrance such that it can slide substantially horizontally in a guide 80. The opening-out mechanism 17 for the door 40 is the same as in the embodiment of FIGS. 1-4. The opening-out mechanism 17 now interacts with the sliding step 1' via a rod 3' and an additional lever 20 which is mounted below the entrance about a horizontal axis parallel to a plane of the door leaf 4. For this purpose, the lever 20 has an opening 18 into which a pin 19 of the sliding step 1' projects. The rod 3' is pivotally mounted both on the lever 9 and on the lever 20. When the lever 20 pivots, it takes along the pin 19, causing the sliding step 1' to extend. When the door 40 closes, the lever 20 is pivoted in the other direction and pushes the sliding step 1' into the locked position. An advantage of this embodiment lies in the fact that the additional lever 20 enables the step drive 30' to be dimensioned in an extremely space-saving manner.

FIGS. 9 to 12 show another embodiment of the of the present disclosure, in which the opening-out mechanism 17 acts directly on the sliding step 1', that is, without connecting elements. To this end, the lever 9 has an elongate continuation or extension 9' directed toward the sliding step P. Provided at a lower end of the extension 9' is an elongate opening 21 into which a pin 19 of the sliding step 1' projects. When the lever 9 together with its extension 9' pivots, the sliding step 1' is thus extended. An advantage of this embodiment lies in the fact that no additional moving parts, such as additional connecting elements and levers, are provided.

The present disclosure is not limited to the embodiments illustrated herein. Thus, for example, an arrangement and number of levers and connecting elements between the opening-out mechanism 17 and the step 1, 1' can be modified depending on the space available in the lower doorway region 50. The lever system itself can be provided with dead-center mechanisms which prevent the step 1, 1' from sliding or folding out while the vehicle is traveling and at the same time relieve the load on the locking system of the door drive 70.

In the embodiments shown, it is the lever 9 of the opening-out mechanism 17 that is connected to the step 1, 1'. However, it is possible for any part of the opening-out mechanism 17 that moves concomitantly during an opening movement, be it a rotating or sliding part, to be used as a starting point for the transmission of the movement to the step 1, 1'. The transmission occurs either directly or via corresponding lever systems and/or connecting elements.

Instead of using bars and levers as connecting elements between the opening-out mechanism 17 and step 1, 1', it is also possible to use cable pulls or Bowden cables. Bowden cables include double cables and flexball cables. In flexball cables, the use of a wire is replaced by a thin steel rail guided by balls, which means that compressive forces can be transmitted as well.

Although the present disclosure has been described and illustrated in detail, it is to be clearly understood that this is done by way of illustration and example only and is not to be taken by way of limitation. The scope of the present disclosure is to be limited only by the terms of the appended claims.

The invention claimed is:

1. A step drive for a movable step, the step drive arranged below a door, the step drive comprising:

an opening-out mechanism located in a region of a closing edge of the door and connected to and activated by a door drive;

the opening-out mechanism including a pivotable lever and a pivotable rod, the pivotable lever being connected at one end to the movable step and including a guide at the other end, the guide having a dead center region and the pivotable rod including a pin movable in the guide; and the pin is located in a dead center region of the guide when the movable step is moved to a locked and retracted position.

2. The step drive as claimed in claim 1, wherein the opening-out mechanism interacts with the movable step via at least one connecting element.

3. The step drive as claimed in claim 2, wherein the at least one connecting element is pivotally mounted to the pivotable lever and is pivotably mounted to the movable step.

4. The step drive as claimed in claim 1, wherein the pivotable lever includes an opening into which a pin of the step projects.

5. The step drive as claimed in claim 2, wherein a length of the at least one connecting element is adjustable.

6. The step drive as claimed in claim 1, wherein the movable step is a folding step.

7. The step drive as claimed in claim 1, wherein the movable step is a sliding step.

8. The step drive as claimed in claim 2, wherein the at least one connecting element is a rod.

9. The step drive as claimed in claim 2, wherein the at least one connecting element is a lever.

* * * * *